United States Patent [19]

Lameyre

[11] 4,018,249

[45] Apr. 19, 1977

[54] TIMING DEVICE FOR PNEUMATIC CONTROL

[75] Inventor: Felix Lameyre, Rueil-Malmaison, France

[73] Assignee: La Telemecanique Electrique, France

[22] Filed: Nov. 12, 1975

[21] Appl. No.: 631,342

[30] Foreign Application Priority Data

Nov. 22, 1974 France ..... 74.38398

[52] U.S. Cl. ..... 137/624.11; 137/596.14

[51] Int. Cl.[2] ..... F15B 21/10

[58] Field of Search ..... 137/624.11, 624.14, 137/625.6, 596.14; 251/63.4, 64, 73, 28

[56] References Cited

UNITED STATES PATENTS 3,931,832 1/1976 Holder ..... 137/624.11

*Primary Examiner*—Alan Cohan

*Attorney, Agent, or Firm*—William Anthony Drucker

[57] ABSTRACT

A bleed valve can take two distinct positions, whereby in the first, in the absence of control pressure, it applies its orifice against a timing device by pneumatic means which it maintains set and in the second it is removed from the device by a certain distance before being caught up by the latter.

This apparatus is used in automatic pneumatic control systems.

5 Claims, 5 Drawing Figures

TIMING DEVICE FOR PNEUMATIC CONTROL

Figure 1:
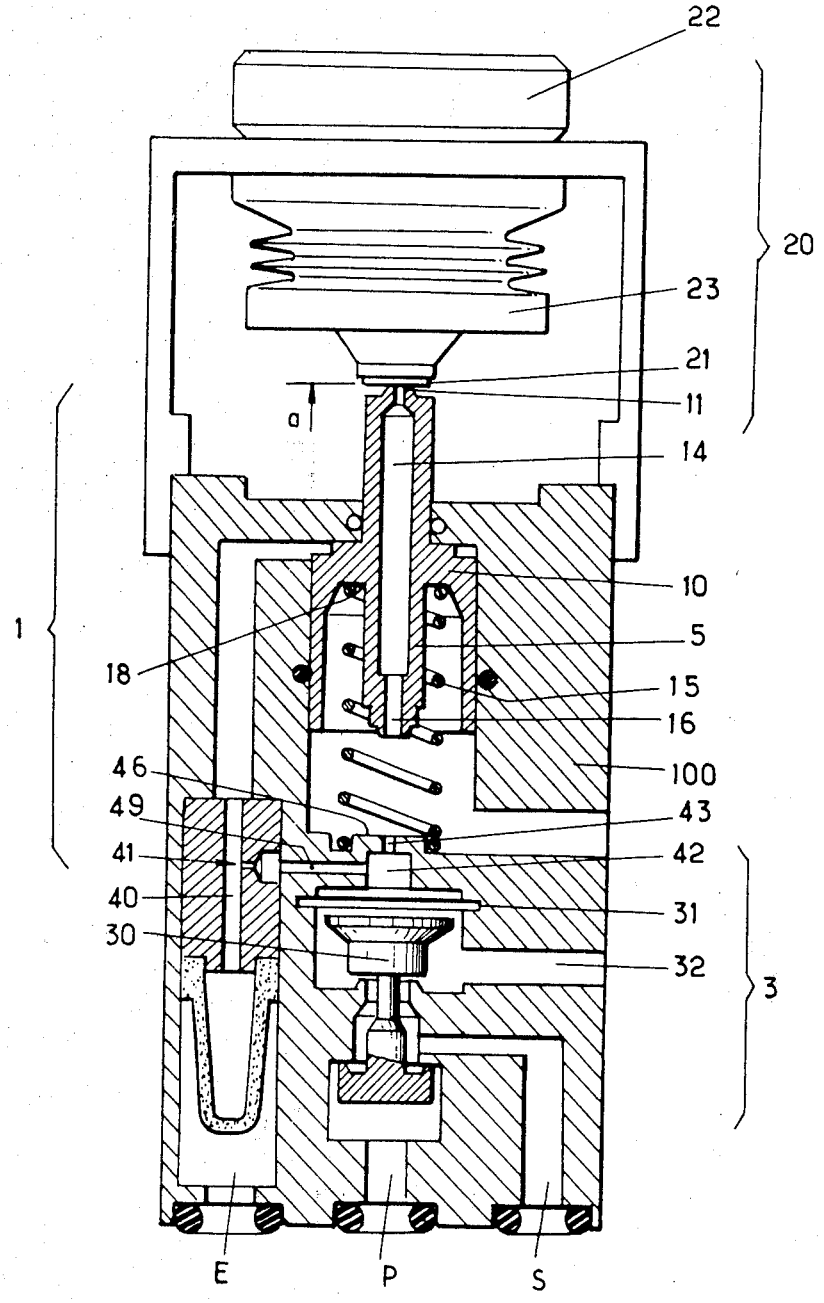

The invention relates to a pneumatic timer comprising an input fluid pipe connected to a setting system for the timing device, to a device for controlling a valve and to an orifice constituting a calibrated leak which is placed facing a movable screen integral with the timing device and which seals the said orifice after a adjustable period of time.

Such timers are at present used in automatic control or monitoring installations for processes using pneumatic means.

Timers for pneumatic control with the construction defined hereinbefore are already known and more particularly a device wherein the orifice is placed at an adjustable distance from the screen whilst the control fluid serves simultaneously for rewinding the timer mechanism and transmitting the output pressure signal. However, in this device the timer is mechanical.

This known device has numerous disadvantages. Firstly the problem of the mobility of the orifice and that of its tight connection is difficult to solve particularly if the movement to be performed is rotary. It should also be noted that in the rest stage, the orifice is exposed to the external atmoshere in such a way that with no fluid leak, foreign bodies emanating from the workshops where the device is being used can block the orifice or modify the characteristics thereof. A further disadvantage is that the same fluid is used for winding up the timer mechanism, for detecting the position of the timer member and for transmitting the discharge order so that the pressure must simultaneously meet these various requirements or the device must call on measures which can satisfy several functions with one pressure.

It should also be noted that the presence of a constriction in series with the control device for the valve represents a systematic delay for disconnection which for certain applications represents a latent defect, whilst without any control fluid it is impossible to simulate the operation of the device.

Furthermore, in the known system, the valve control device is such that it reacts to relatively large pressures and involves the use of a movable spool valve whose early wear can be expected due to the friction to which it must inevitably be exposed.

Finally, as the timer is mechanical, the device utilizes two different techniques so that assembly and maintenance involves calling on different specialists for both of whom the other technique is generally an unknown quantity. Thus, unexpected difficulties can occur particularly in the case of breakdowns whilst the arrangement of the said timer substantially excludes rapid interchangeability with a view to modifying the timing ranges.

The invention, therefore, proposes to obviate the above-indicated disadvantages by utilising measures which successively eliminates the causes thereof and aims more particularly at supplying a pneumatic timer which ensures regularity of operation and clearness of the orifice.

The invention also aims at supplying an apparatus wherein the only orifices or openings which may be exposed to dust are of dimensions such that the presence of dust does not represent a hazard for their operation.

Finally, additional measures are taken so that the techniques used are based solely on pneumatics and the control and output circuits are independent in order to permit simulation of operation.

According to the invention, the first object is obtained through the orifice being carried by a moving member which can assume two extreme positions, i.e. in the absence or in the presence of the input control pressure, whereby in the first position, in the absence of control fluid, the orifice is constantly applied in elastic manner to the screen whilst maintaining the timing device in its set state and in the second position where, in the presence of control fluid, the moving member is removed from the screen by a predetermined distance and at this time effects a pneumatic connection permitting control fluid to be supplied to the valve control device and the orifice.

Figure 2:
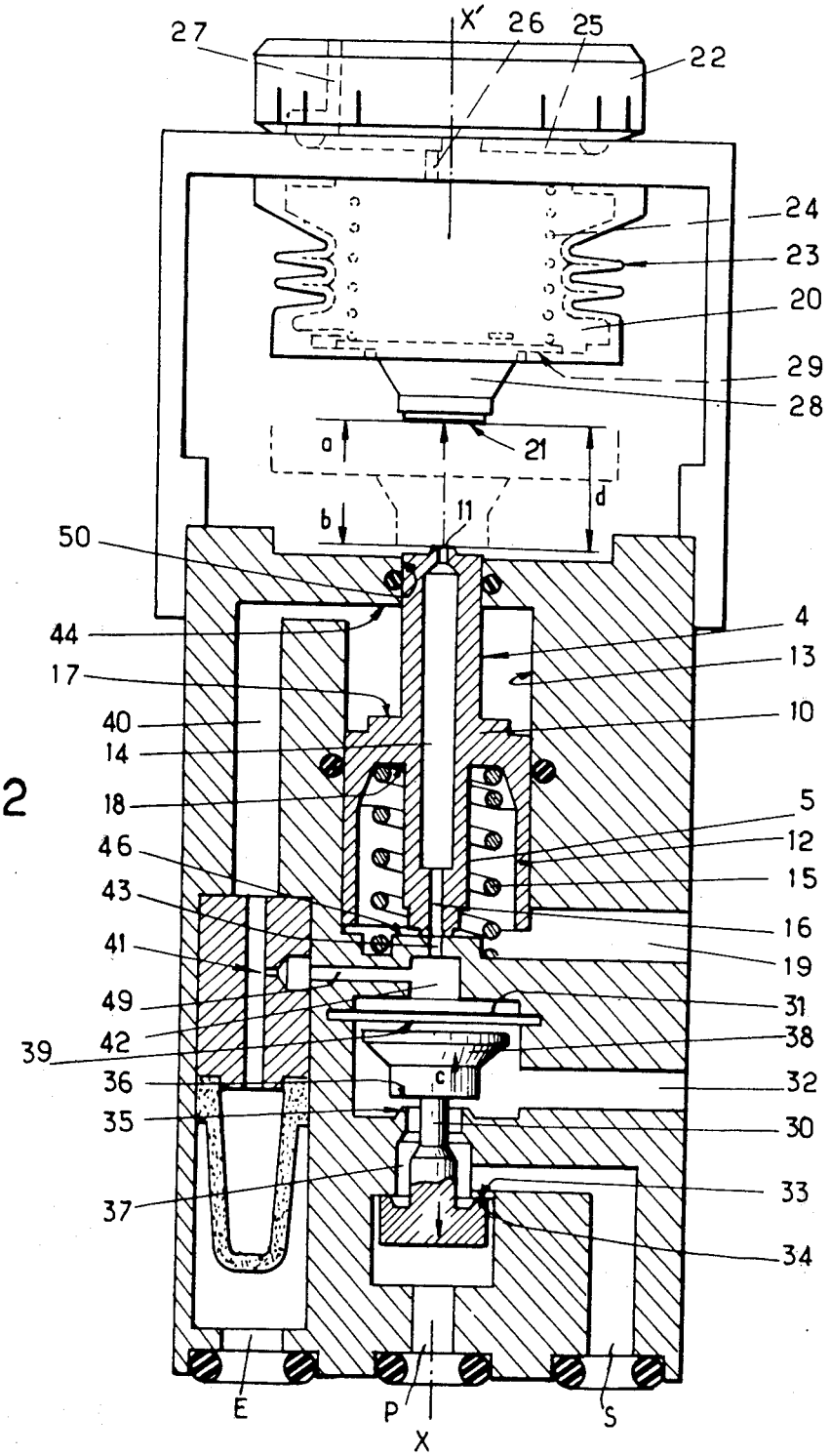
Figure 3:
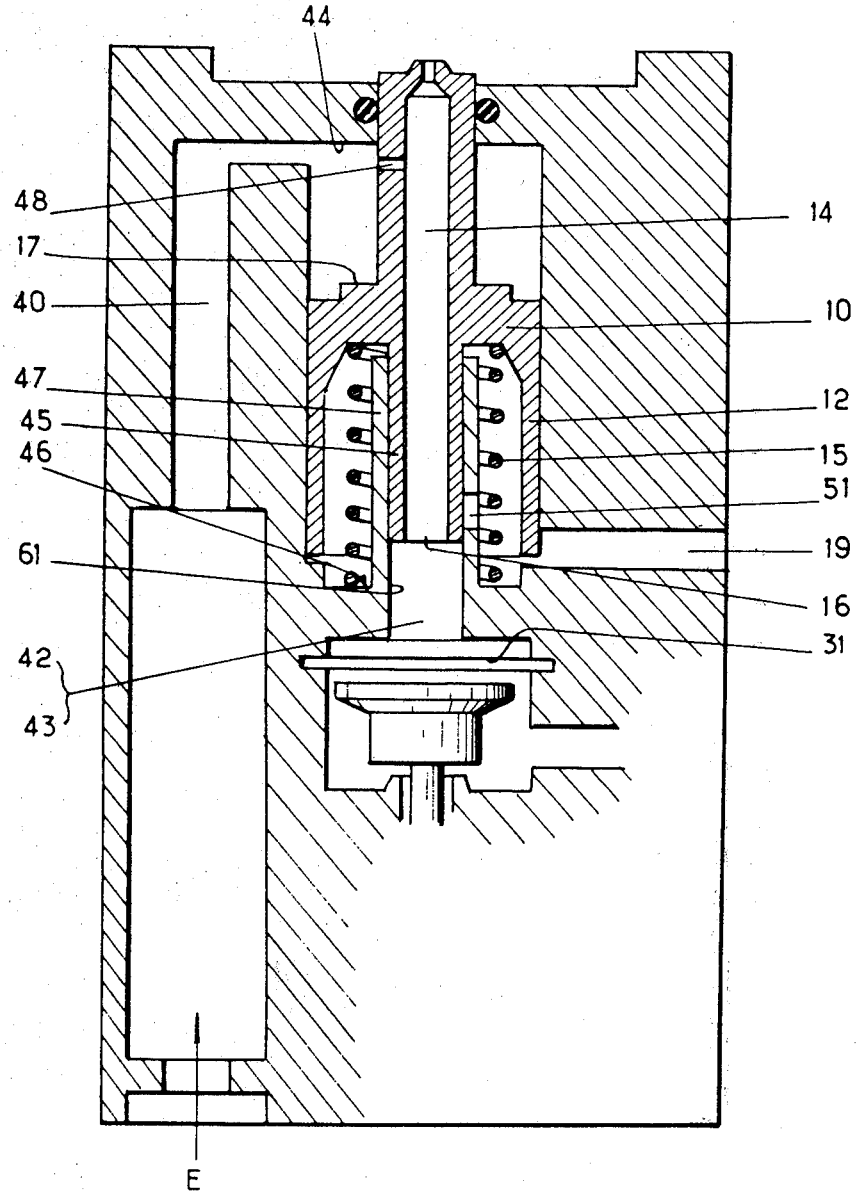
Figure 4:
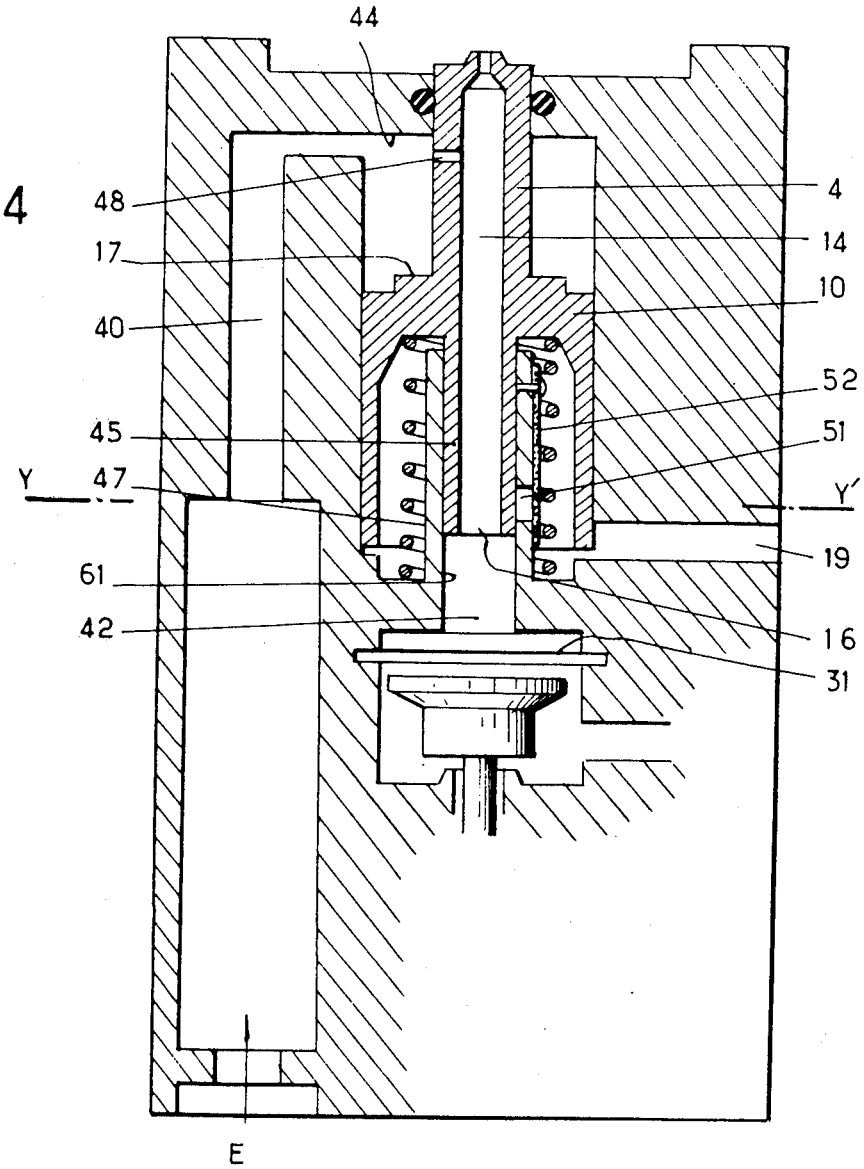
Figure 5:
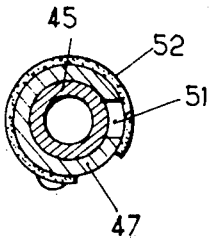

Other interesting characteristics aiming at improving the apparatus will be better understood from reading the following description accompanied by the drawings, wherein show:

FIG. 1 the timer in its rest position;

FIG. 2 the timer at the time where input control pressure has been applied;

FIG. 3 a variant of the timer in its working position;

FIGS. 4, and 5 a variant of the timer according to FIG. 3 whereby

FIG. 5 is a sectional view along the line YY′ of FIG. 4.

The timer shown in FIGS. 1, 2 and 3 substantially comprises a body 100 which comprises two assemblies of members 1 and 3, whereby assembly 1 has the function of setting the timer and establishing the pneumatic connection necessary for the various operating phases, whilst assembly 3 brings about the desired pneumatic commutation.

A third assembly of members 20 constituting the actual timer device is arranged is easily detachable manner on body 100.

The deformable bellows 23 assumes its maximum volume under the action of a compression spring 24 placed within the same. This compression spring acts on the movable base of the bellows via a valve 29 which has an extension 28 projecting with respect to the base. Extension 28 has in turn a screen 21. When the bellows is in the position shown in FIG. 1 a force applied to screen 21 in the upward direction of the drawing is transmitted to valve 29 in order to open the same and consequently permit a rapid penetration of air into the bellows which can therefore be compressed very rapidly.

If, however, as shown in FIG. 2, the bellows is compressed but can still be elongated valve 29 is closed and air can only enter the same via a circuit comprising successively a first pipe 27 in control knob 22, a portion of a circular tube 25 which forms a throttling tube 86 a variable length and a second pipe 26 which connects the inside of the bellows to tube 25.

During the time regulation, pipe 27 can move in front of throttling tube 25 in such a way that to each angular position of the knob corresponds a different length of the throttling circuit and consequently an also different bellows elongation speed. Such systems are known per se and that shown in the drawing is used not only due to its small size but also because it is entirely pneumatic and the operating variations to which it can be subjected are of the same nature as those which can occur on the remainder of the apparatus. The detachable assembly 20 is constructed and located relative to body 100 in such a way that it can be easily replaced corresponding to the desired timing ranges.

The body 100 of the apparatus has on the one hand a first pipe 40 which is connected to an input control fluid port E via a filter and on the other hand to the upper surface 44 of a cylinder 13 whose lower base 46 is connected with atmosphere by exhaust 19. Base 46 of the cylinder is linked with a compression chamber 42 by an opening 43.

In the embodiment shown in FIGS. 1 and 2, the compression chamber 42 is limited by a deformable membrane 31 and is connected to pipe 40 via a line 49 having a constriction 41 of clearly defined dimensions.

The upper base 44 of cylinder 13 also has a cylindrical opening 50 coaxial thereto which contains a gasket.

A piston 10 whose case 12 guides the stroke thereof is arranged within the same cylinder. The central portion of the piston has a concentric tube 14 which is extended on the upper surface 17 of the piston by a cylindrical portion 4 sliding sealingly in opening 50. On the lower base side 46 of the cylinder, the tube has an extension 5.

The ends of the tube 14 have on the one hand a metering hole 11 facing screen 21 described hereinbefore and on the other an opening 16 which faces opening 43.

A spring 15 located between the base 46 of the cylinder and the lower surface 18 of the piston forces the latter upwards and positions orifice 11 in the position indicated by (a) in FIG. 1.

When, as a result of the input control pressure signal, the piston arrives in the position shown in FIG. 2 opening 16 is applied to base 46 of the cylinder and via a joint establishes a sealed connection with opening 43.

The assembly of members 3 serves to provide a pneumatic connection between output port S and either exhaust port 32 or a constant pressure supply P. This selection is operated by a double valve 30, known per se, comprising a first frame with a seat and puppet 33, 34 which closes under the action of pressure P and a second frame with a seat and puppet 35, 36 connected to the first which is open when the latter is closed and conversely. Output pipe S is connected to an inner volume 37 placed between the two seats and concentric to the double valve. The said valve has a revolution shape and is not radially guided by a permanent friction.

When pressure P is applied and the double valve is in its upper position, a thrust head 38 of the valve is located adjacent to surface 39 of membrane 31 opposite to compression chamber 42.

The apparatus is connected on the one hand to a constant pressure supply applied to port P and on the other to a pipe terminating at port E wherein a input control pressure signal appears at a certain time.

The timer must supply a discharge signal to port S for a utilization not defined here after a space of time which is adjustable in accordance with the appearance of the input control signal.

The apparatus operates as indicated hereinafter.

In the absence of the input control pressure but in the presence of the permanent supply pressure P, the apparatus is in the rest state shown in FIG. 1.

Piston 10 is located in its upper position referenced by (a) and orifice 11 is then sealed by screen 21. This state is obtained due to the fact that the force developed by spring 15 is greater than the oppositely directed force exerted by spring 24 of the timing device.

Assembly 3 is therefore only subject to pressure P and is in a state where the double valve 30 connects output pipe S to exhaust 32.

When the input control pressure E appears in pipe 40, the piston is moved downwards by the pressure acting on upper surface 17 thereof and reaches the position b illustrated in FIG. 2 after having performed a fixed travel equal to d. At this time opening 16 is applied to base 46 and pressure E after traversing constriction 41 communicates through channels 49 and 43, then tube 14, resulting in a fluid leak via orifice 11 which is calibrated as a function of the input control pressure value E and the size of the constriction. As the two openings 16 and 43 are only linked at the final moment of the downward stroke of the piston, it is obvious that the compression chamber 42 is connected to atmosphere at 19 until the time when this connection takes place. The small pressure occurring in this chamber due to the calibrated leak is insufficient to bring about a significant deformation of membrane 31. Is should be noted that the downward movement of the piston is extremely fast because the lower surface 18 of the piston is connected to exhaust 19.

At the time when orifice 11 separates from screen 21, bellows 23 of the timer member deforms in order to displace screen 21 in the downward direction with the speed depending on the angular position of control knob 22. When screen 21 has moved downwards by a distance equal to d to assume the position indicated in dotted lines in FIG. 2, orifice 11 is sealed thereby and the pressure within the compression chamber 42 rises rapidly. At a certain value of this pressure membrane 31 deforms downwards and pressure head 38 of double valve 30 bringing about the communication of discharge orifice S with the permanent supply pressure applied at P. This pneumatic commutation occurs with a certain time lag relative to the time when the input control pressure signal E appears in pipe 40.

As soon as the input control pressure E disappears, the pressure in compression chamber 42 suddenly disappears due to the fact that opening 43 is linked to atmosphere as soon as the piston starts to rise and because the very rapid rise of the piston causes a slight suction effect which sucks in the membrane 31.

Thus the closing of valve 30 is extremely rapid due to the rapid return of the membrane to its rest position.

The apparatus then assumes the rest position shown in FIG. 1.

It can be seen that with the selected arrangement, only opening 16 and 43 can be affected by dust. However, their dimensions and positions make this possibility very improbable.

In the variant shown in FIG. 3 where the members fulfilling the same functions have been given the same reference numerals, the base of the cylinder has a cylindrical member 47 wherein slides a cylindrical portion 45 of tube 14 comparable to extension 5 of the piston described in the previous embodiment. Thus the inside 61 of case 47 represents a channel comparable to channel 43 and to compression chamber 42 in FIG. 1 and 2, whilst the open ends 16 of tube 14 in turn corresponds to opening 16 in the same drawings.

However, compression chamber 42 is not connected to pipe 4o in the same way but instead via a pipe present in the centre of tube 14 and by a constriction 48 made in the upper extension 4 and terminating in the upper area of the cylinder connected to the control pressure pipe 40 as hereinbefore.

This constriction can be placed at different levels, i.e., close to surface 17 of the piston or at a more remote level. In both cases, it is necessary to ensure that the sudden drop of the piston does not lead to an undesired overpressure in compression chamber 42. This result can be obtained either by an appropriate calibration of orifice 11 or through the presence of a bore 51 in body 47 and connected to exhaust 19, whereby the bore is substantially sealed when the piston is in the lower position. It should be noted that channel 40 is connected with orifice 11 and the compression chamber in the second position of the piston.

Operation is substantially the same as that described relative to the previous embodiment, but it should be noted that the suction effect when pressure E disappears and consequently the valve commutation speed is even greater that in the previous embodiment. Another advantage results from the fact that constriction 48 and orifice 11, whose dimensions must be well proportioned, are provided on the same member so that the openings are even better protected against dust in filtration.

This variant can be modified by giving case 12 the function of tube portion 45. The cylindrical body is then represented by the portion of cylinder 13 adjoining base 46 which still has an opening such as 43. Exhaust pipe 19 still permits here the draining of the cylinder when piston 10 drops to position b up to the time when the case approaches base 46 or engages with the same.

In all the illustrated embodiments, it can be seen that the movable members selected for each function are revolution members which have a low cost price and which permit easy construction by moulding and cutting off, whilst the necessary alignment precision is obtained by selecting a common axis of symmetry XX'. Only the fluid supply and discharge pipes, which are subject to no particular constraint do not comply with this symmetry.

In the case of timers for use on automatic equipment involving pneumatic means, generally it is merely important to generate an output signal which is delayed relative to the appearance of the input control signal. However, a commutation delay can also be desired following the disappearance of the input control signal.

The variant of the apparatus of FIG. 3 shown in FIG. 4 makes it possible in particularly simple manner to bring about a delay of the output signal with respect to the cutting off of the input control pressure.

If the desired delay is fixed, it is merely necessary to place a very simple lack valve, e.g., an elastic blade 52, also shown in FIG. 5 over bore 51 which only permits chamber 42 to decompress slowly via orifices 11 and constriction 48 without preventing the evacuation of air contained in the pipe during the downward movement of the piston. If it is necessary to be able to regulate this delay by a manual action from the outside of the casing, it is possible to adopt a construction where, according to the angular position of the piston, more or less long grooves make it possible to connect more or less rapidly chamber 42 with orifice 51.

It is obvious that the invention can be modified and improved without altering the scope thereof. Thus, it is possible to provide a timer wherein the rewinding of the timer member spring can be obtained either by the pressure of a fluid at an appropriate pressure acting beneath the piston or by magnetic or electromagnetic means.

I claim:

1. In a pneumatic control system of the type comprising a control valve and an inlet for a control pressure, a timing device for adjustably delaying the shifting of said control valve after application of said control pressure to said inlet, said timing device comprising:

a shutter movable from a first to a second position; time delay means for displacing the movable shutter from the first to the second position in a predetermined adjustable time delay; a first conduit provided with the said control pressure inlet; pressure responsive means movable in response to pneumatic pressure, said pressure responsive means being operatively connected to said first conduits; a second conduit having an orifice connected to exhaust a throttle connecting the first conduit to the second conduit; a tubular member linked to said pressure responsive means and having first and second openings at the respective first and second ends thereof, said tubular member being movable between a first predetermined position in which the first end thereof engages the shutter and the first opening is closed while the second opening is open and a second predetermined position in which the first opening is open while the first end of the tubular member is separated from the shutter by a predetermined distance and the second opening is connected to the said orifice; resilient means cooperating with the tubular member and being adapted to maintain the first end thereof in engagement with the shutter to place the shutter in its first position; the shutter engaging the first end of the tubular member and closing the first opening thereof when both the shutter and the tubular member are in their second position; and means for shifting said control valve, said shifting means being responsive to a variation of pressure within the second conduit.

2. A timing device according to claim 1, said timing device further comprising a compression chamber connected to the second conduit, a deformable membrane closing the said compression chamber, the control valve comprising a double puppet mounted for cooperation with said membrane.

3. A timing device according to claim 1, wherein the pressure responsive means comprises a cylinder having first and second base members; a piston cooperating with the said cylinder; said piston having a central tubular member, the first end of said tubular member being mounted across the first base member, the second base member being provided with the said orifice connected to the exhaust, said resilient means consisting of a spring having two ends respectively engaging the second base and the piston.

4. A timing device according to claim 1, wherein the said time delay means comprise a deformable bellows; a spring mounted within the bellows; a throttling channel of curved configuration connected to the bellows; and control means for controlling the operative length of the throttling channel.

5. In a pneumatic control system of the type comprising a control valve and an inlet for a control pressure, a timing device for adjustably delaying the shifting of said control valve after application of said control pressure to said inlet, said timing device comprising:

a shutter moving from a first to a second position; time delay means for displacing the movable shutter from the first to the second position in a predetermined adjustable time delay; a first conduit provided with the said control pressure inlet; pressure responsive means movable in response to pneumatic pressure, said pressure responsive means being operatively connected to said first conduit; a compression chamber having an orifice connected to exhaust; a tubular member linked to said pressure responsive means and having an elongated wall and first and second openings at the respective first and second ends thereof, said tubular member being movable between a first predetermined position in which the first end thereof engages the shutter and the first opening is closed while the second opening is open and a second predetermined position in which the first opening is open while the first end of the tubular member is separated from the shutter by a predetermined distance; the second opening communicates with the compression chamber and the said orifice is closed; resilient means cooperating with the tubular member and being adapted to maintain the first end thereof in engagement with the shutter to place the shutter in its first position; the shutter engaging the first end of the tubular member and closing the first opening thereof when both the shutter and the tubular member are in their second position; a throttle orifice provided through the wall of the tubular member, at such a distance from the first end thereof that the said throttle orifice communicates with the first conduit when the tubular member is in its second position, while the said throttle orifice communicates with the exhaust when the tubular member is in its first position; and means for shifting said control valve, said shifting means being responsive to a variation of pressure within the compression chamber.

* * * * *